US012000132B1

(12) United States Patent
Burns

(10) Patent No.: US 12,000,132 B1
(45) Date of Patent: Jun. 4, 2024

(54) APPEARANCE CHANGING URINE SPLATTER SUPPRESSION DEVICE

(71) Applicant: Seung Kook Kawase Burns, Mine Hill, NJ (US)

(72) Inventor: Seung Kook Kawase Burns, Mine Hill, NJ (US)

(73) Assignee: Seung Kook Kawase Burns, Mine Hill, NJ (US)

( * ) Notice: Subject to any disclaimer, the term of this patent is extended or adjusted under 35 U.S.C. 154(b) by 0 days.

(21) Appl. No.: 18/339,235

(22) Filed: Jun. 22, 2023

(51) Int. Cl.
*E03D 9/00* (2006.01)
*E03D 13/00* (2006.01)

(52) U.S. Cl.
CPC ..... *E03D 9/00* (2013.01); *E03D 13/005* (2013.01)

(58) Field of Classification Search
CPC ..... E03D 9/00; E03D 13/005
See application file for complete search history.

(56) References Cited

U.S. PATENT DOCUMENTS 4,044,405 A 8/1977 Kreiss
4,062,070 A * 12/1977 Prince ..... E03D 9/00 4/300.3
4,215,443 A 8/1980 Babik
4,866,793 A * 9/1989 Luedtke ..... E03D 9/00 4/300.3
5,363,516 A 11/1994 Butts
5,809,590 A 9/1998 Williams et al.
5,867,848 A 2/1999 Ort
10,294,649 B2 * 5/2019 Crevier ..... E03D 13/005
10,779,694 B1 9/2020 Walker
11,473,285 B2 10/2022 Herbert
2007/0039096 A1 * 2/2007 Smitherman ..... E03D 9/00 4/661

(Continued)

FOREIGN PATENT DOCUMENTS

CH 2339640 Y * 9/1999
CH 2434353 Y * 6/2001

(Continued)

OTHER PUBLICATIONS

Cn 2434353Y Machine English translation printed Mar. 19, 2024 (Year: 2024).*

(Continued)

*Primary Examiner* — Christine J Skubinna

(57) ABSTRACT

A urine splatter suppression device with appearance changing properties is provided. The device comprises a base that engages the bowl of a toilet or urinal, a hydrodynamic target with liquid impinging features and a security tether to prevent accidental flushing. The base can be in the form of a suction cup that engages the bowl of a toilet. The target may comprise a spheroidal shape to absorb and diffuse the impact from a urine stream; any subsequent splash back may be captured by anti-splash protrusions and apertures that comprise the surface. The target is made or coated with thermochromic materials and changes appearances when warm liquids such as urine contact it, and can change again, as well as self-cleanse, when cool water is flushed over it. The device's appearance-changing novelty will encourage males, especially young boys who are prone to distraction to urinate on target and keep lavatories sanitary.

20 Claims, 5 Drawing Sheets

(56) References Cited

U.S. PATENT DOCUMENTS

| | | | | |
|---|---|---|---|---|
| 2021/0233425 | A1* | 7/2021 | Longton | G01K 11/12 |
| 2023/0193612 | A1* | 6/2023 | Ogles | E03D 9/00 4/300.3 |

FOREIGN PATENT DOCUMENTS

| | | | | |
|---|---|---|---|---|
| CN | 109372071 | A * | 2/2019 | |
| DE | 29913533 | U1 * | 12/1999 | A47K 17/00 |
| GB | 2423709 | A * | 9/2006 | E03D 13/005 |

OTHER PUBLICATIONS

Etsy, "Toilet Anti-Splash Pad", www.etsy.com/listing/701025525: Accessed Jun. 12, 2023.
Kickstarter, "The Piss Pad by New Normal", www.kickstarter.com/projects/purp/the-piss-pad: Accessed Jun. 12, 2023.

* cited by examiner

APPEARANCE CHANGING URINE SPLATTER SUPPRESSION DEVICE

FIELD OF THE INVENTION

The disclosed subject matter relates generally to lavatory accessories, and more particularly to an appearance changing anti-splash device for use with a toilet or urinal.

BACKGROUND OF THE INVENTION

Males who urinate in a standing orientation have almost all experienced issues with waste water splatter. When a stream of high velocity urine is projected into a toilet or urinal and the urine makes contact with the hard porcelain surface or standing water, it more often than not results in some splash back outwardly from the interior region of the urine receptacle. This generally causes the lavatory and sometimes the user himself to become wet with waste fluid, causing unsanitary, unpleasant and malodorous conditions. As a result there is a need for a urine splash back suppression device for toilets and urinals.

In addition, many males, especially younger boys who are just learning to urinate while standing, may miss the toilet bowl completely resulting in increased unsanitary conditions within the lavatory environment. Having an enticing target to concentrate their urine stream on is of immense importance.

Prior methods have been developed in an attempt to solve some but not all these issues. Splash guards especially in regards to urinals are wide-ranging and ubiquitous, however the vast majority rely solely on flat mats with bristles that are hard to clean, costly, and do not make use of their shape to diffuse the water in an intelligent streamlined hydrodynamic manner. Splash guards that are compatible with toilets for male users urinating in a standing orientation are exceedingly rare and no commercially successful product exists. The prior art for toilet compatible splash guards have several short comings: some are floating and/or in the direct path of falling/flushing excrement, most require manual cleaning and end up creating more problems than they solve, some are one-time use and unsustainable, while still others require invasive alterations to the toilet itself. A low cost, simple, easy-to-install, reusable, effective, maintenance free, excrement-avoiding, self-cleaning, toilet-compatible splash guard is needed.

Targets do exist to focus user's urine streams to optimal locations and usually take the form of a fly or water droplet that is affixed, etched or painted onto urine receptacles.

While these targets have been cited to reduce spillage by as much as 80%, they could be made much more effective by having anti-splash features incorporated onto the target itself and much more engaging by generating a visual response when the user hits the target.

Accordingly, the art of fluid splash containment and targets as it relates to lavatory accessories would benefit from an improved all-in-one device to address the problems and shortcomings associated with prior methods.

SUMMARY OF THE INVENTION

The present invention provides a urine splatter suppression device that can be affixed to the bowl of a toilet or urinal and will perform a thermally actuated noticeable appearance change when a warm stream of urine or cold flush washes over it.

A principle object of the invention is to prevent urine splatter, this can be achieved by a hydrodynamically shaped three dimensional target which absorbs the impact from a stream of urine and allows it to diffuse around it. The target can also have liquid impinging protrusions and apertures to minimize any additional splash back.

It is a further object of the invention to prevent accidental flushing of the device and potential costly plumbing damages should the primary mode of affixment fail. This issue is solved by including a back-up tether that can be affixed from the device to a permanent fixture on the toilet or urinal, such as the water supply line.

It is a further object of the invention to be low maintenance and self-cleansing by being affixed in a location and manner to avoid contact with excrement, and within the path of flushing water so as to self-cleanse with every flush.

The targets appearance-changing novelty will encourage males, especially young boys who are prone to distraction to urinate on target and keep the lavatory sanitary and free of malodorous odors.

BRIEF DESCRIPTION OF DRAWINGS

FIG. 58 is a perspective view of the appearance changing urine splatter suppression device of FIG. 5A;

DETAILED DESCRIPTION OF THE INVENTION

Figure 1A:
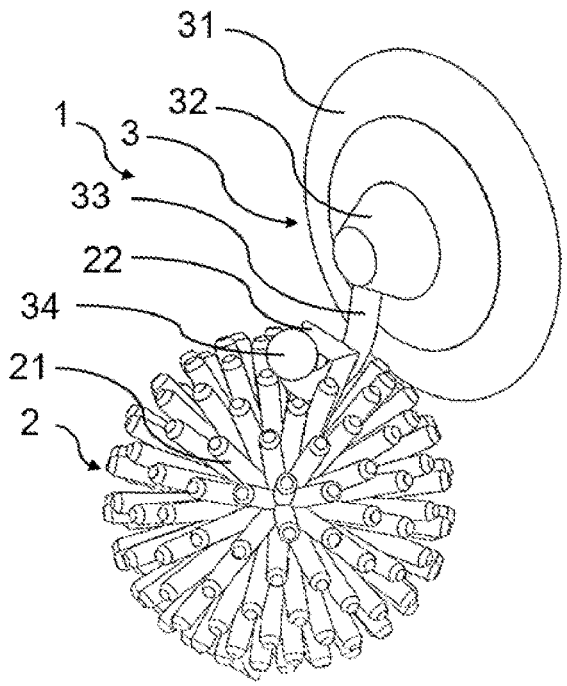
FIG. 1A is a perspective view of the appearance changing urine splatter suppression device of a preferred embodiment.
Figure 1B:
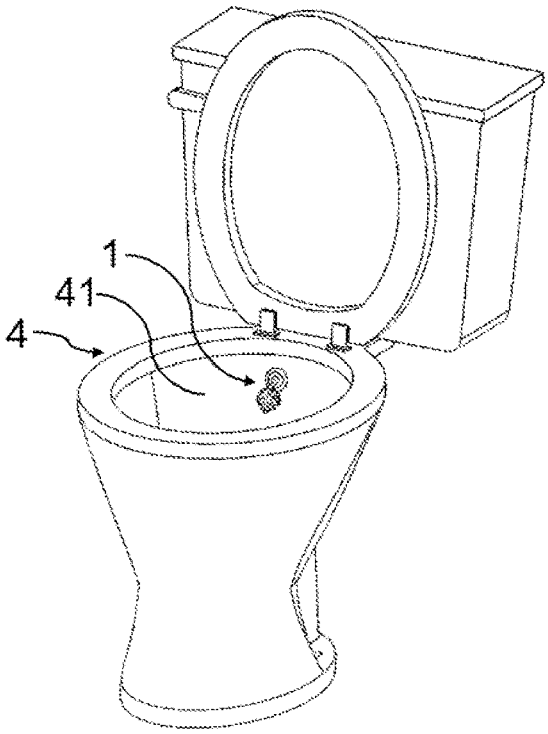
FIG. 1B is another perspective view of the appearance changing urine splatter suppression device of the preferred embodiment installed in the bowl of a toilet.
Figure 1C:
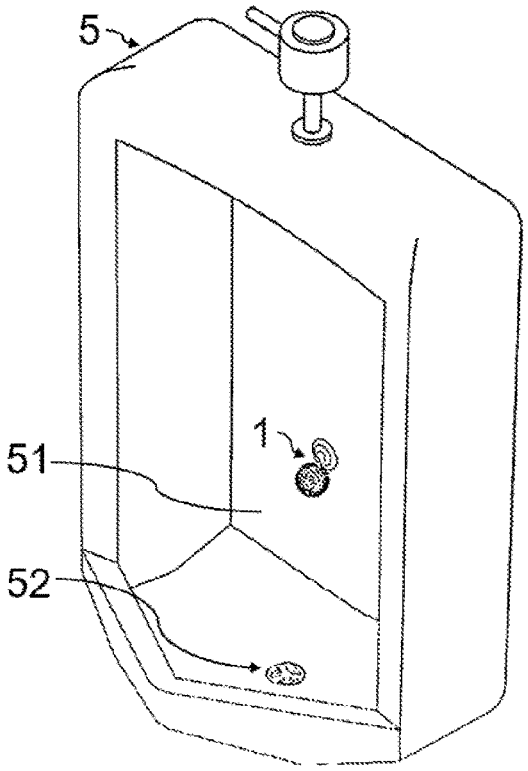
FIG. 1C is another perspective view of the appearance changing urine splatter suppression device of the preferred embodiment installed in the bowl of a urinal.
Figure 1D:
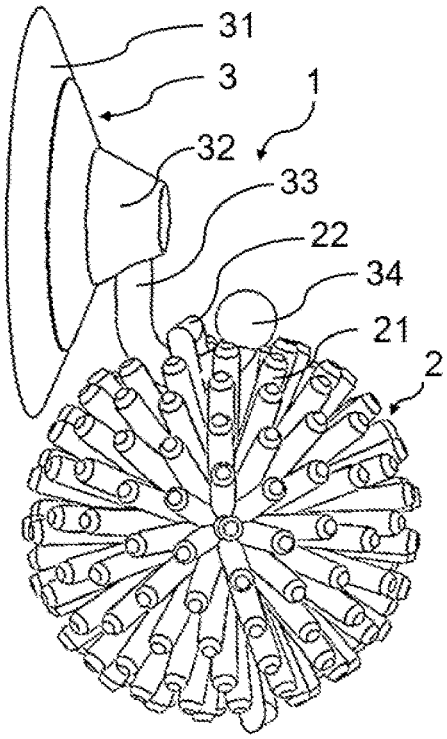
FIG. 1D is another perspective view of the appearance changing urine splatter suppression device of a preferred embodiment.
Figure 2:
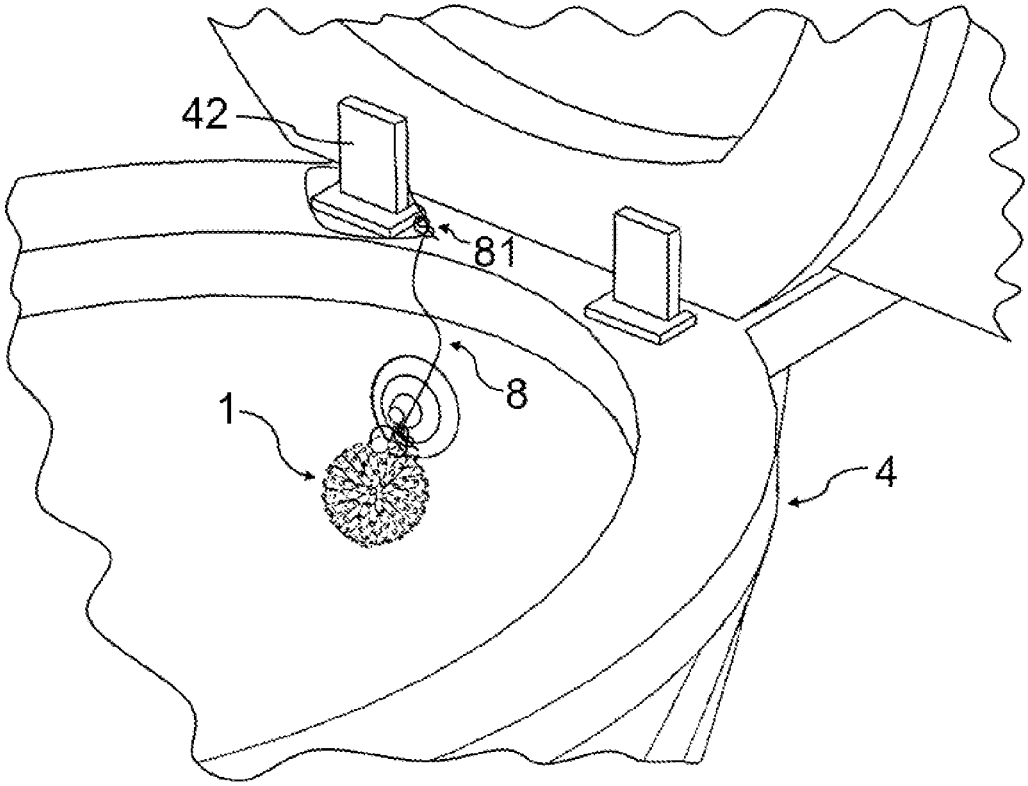
FIG. 2 is another perspective view of the appearance changing urine splatter suppression device installed in the bowl of a toilet illustrating how a backup elongated flexible member can be configured to tether the device to the toilet.

A preferred embodiment of the appearance changing urine splatter suppression device is illustrated in FIGS. 1-2, and generally designated 1. The appearance changing urine splatter suppression device 1 generally includes an appearance changing anti-splash target 2 and a suction cup base 3 that affixes the device 1 to a toilet 4 as shown in FIG. 18 or a urinal 5 as shown in in FIG. 1C.

Figure 7A:
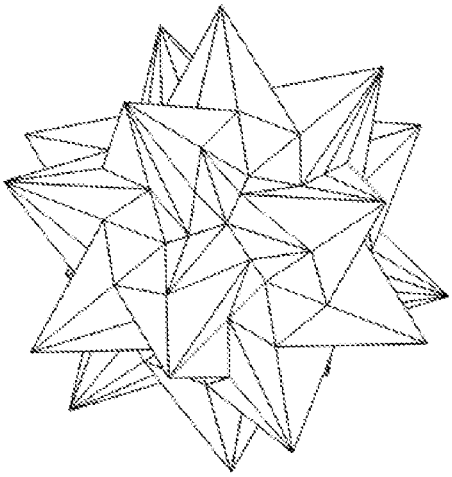
FIGS. 7A-7F illustrates additional alternative embodiments the appearance changing anti-splash target comprises.
Figure 7B:
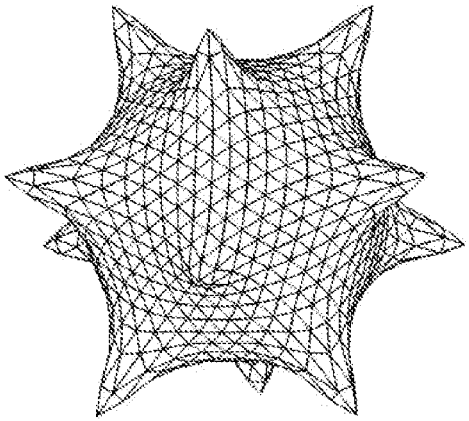
Figure 7C:
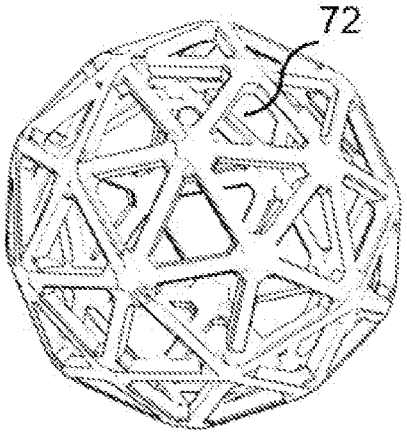
Figure 7D:
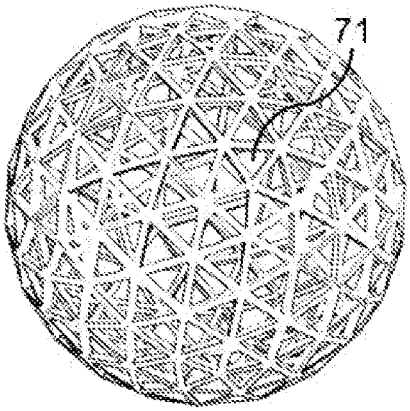
Figure 7E:
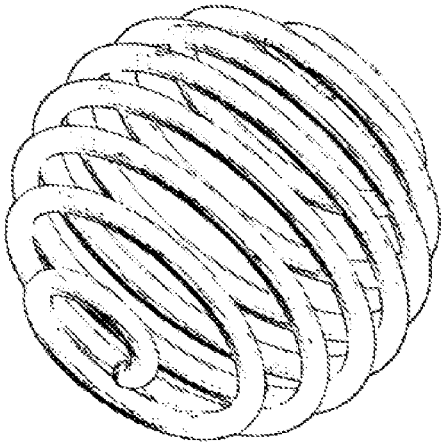
Figure 7F:
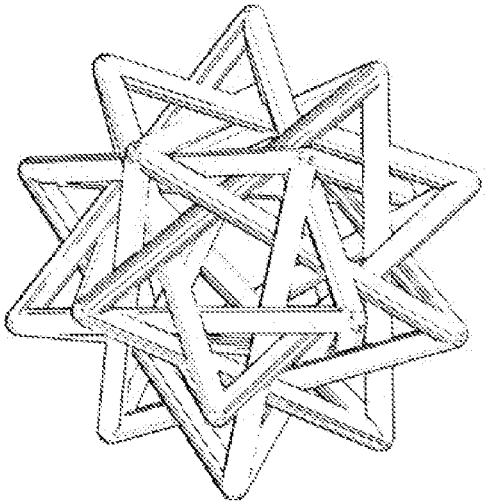
Figure 9:
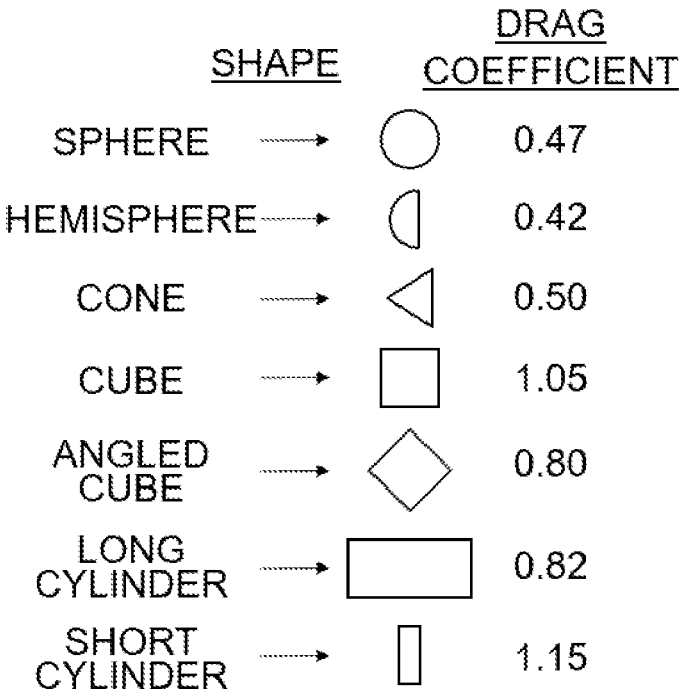
FIG. 9 is a chart showing standard fluid drag coefficients for various three-dimensional shapes.

The target 2 comprises a spheroidal shape with a plurality of liquid impinging protrusions 21. The spheroidal shape is just one embodiment of many hydrodynamic shapes that can be used, please refer to FIG. 4A & FIGS. 7A-7F for some other potential embodiments the target may comprise including but not limited to: spheroids, spheres, ellipsoids, frustocones, cones, hemi-spheroids, domes, cupolas, geodesics, polyhedrons and hemi-polyhedrons. FIG. 9 shows many three-dimensional shapes and their corresponding drag coefficients, drag coefficients are a measure of drag or resistance an object has in a fluid environment; the lower the drag the more hydrodynamic the shape is, and consequently the less turbulence, resistance, and splash-back it will cause when coming into contact with a fluid stream like urine. In the spirit of this invention, any shape with a drag coefficient less than 0.75 will be considered hydrodynamic. Referring to FIG. 9, a sphere has a drag coefficient of 0.47 and would therefore be considered hydrodynamic; conversely, a cube with a drag coefficient of 1.05 would not be considered hydrodynamic. The hydrodynamic shape is important, but another important element of the shape's splash reduction efficacy is its size relative to the fluid stream it is interacting with. For instance, even though a basketball is spherical, due to the extraordinary size as compared to a urine stream, if one were to urinate onto the center of a basketball, it would be inconsequentially different than urinating on a flat sheet and the splash back effects would be excessive; swap the basketball for a ping pong ball and now the hydrodynamic shape can help facilitate less splash back since the angle of incidence is much less as the urine stream makes contact with the curves of the smaller ping pong ball and disperses the urine stream around it. The average urine stream is around 5 mm in diameter when it exits the male urethra, and breaks into droplets about 6 inches from exiting; by the time it hits the toilet bowl a majority of droplets will have spread out enough to land in a 15 mm diameter area. Knowing this, the optimal diameter size for the hydrodynamically shaped target is between about 15 mm and 50 mm. While a hydrodynamically shaped target greater than 50 mm could still reduce splash back if a urine stream was focused not on the center but at the peripherals of the larger target, such a target would have a greater propensity for coming into contact with falling or flushing excrement, and be less-likely to completely self-cleanse with flushing water. The hydrodynamically shaped target 2 absorbs the main impact from a stream of urine and allows the urine stream to dissipate around it while preventing the splash back and ricochets typically seen when urine streams hit the flat surfaces of a toilet bowl 41 or urinal bowl wall 51. Further impinging any urine splash back and ricochets are the plurality of protrusions 21 which also helps to deaden the force of the urine stream and allow the urine to quietly and calmly dribble down towards the drain of the toilet 4 or urinal 5. The plurality of protrusions generally extend outwardly from the hydrodynamically shaped base the protrusions cover. In other embodiments, instead of a plurality of protrusions 21, alternative embodiments of the target as can be seen in FIG. 7C & FIG. 7D can comprise a plurality of apertures 71, 72 which may also act to reduce urine splash back. Some embodiments can contain apertures that are so numerous they can create a fine mesh that lets a concentrated urine stream in, but prevents any stray splash back from escaping out of it. In still other embodiments, as illustrated in FIG. 7F the target can comprise a mesh of densely packed filaments which redirects and diffuses urine in all different directions deadening the impact and allowing the urine to quietly and calmly dribble down along the toilet bowl 41 or urinal bowl 51 towards the drain. In still yet another embodiment the target can comprise a singular spiraled filament as illustrated in FIG. 7E. In still yet another embodiment the target can comprise a cone or series of conical features as illustrated in FIG. 7B. In still yet another embodiment the target can comprise a polyhedron as illustrated in FIG. 7A. In still yet another embodiment the target can comprise a hemispheroidal shape as illustrated by an alternate embodiment of the target 2B in FIGS. 4A & 4B. All of these embodiments of the target act in one way or another to limit, diffuse, channel, redirect, restrain, slow and/or impinge the urine stream and thereby reduce splash back. One additional benefit to the protrusions, or abundance of apertures on an object, or mesh of densely packed filaments is that they have or can cause tiny structural members with smaller cross-sections that are coated or filled with thermochromic material; and because the members are small, they heat and cool relatively quickly and can change from one appearance state to the other rapidly, resulting in a satisfying almost immediate visual response. While the hydrodynamically shaped target has been described with respect to a number of different compositions of shapes and anti-splash features, still other compositions can easily be created from those skilled in the art. The hydrodynamically shaped target should therefore be construed to include all those compositions within the spirit and scope of the later stated claims.

In some embodiments, the target 2 may be made of a material that is flexible and tough, such as PVC plastic, EVA, or the like. In other embodiments, the target 2 may be composed of a composite material, a metallic material, or another material conducive for placement in a urine receptacle. In one advantageous embodiment, the target 2 may include a fragrance embedded within the material of the target 2 during the manufacturing process, e.g., during the extrusion or molding phase of the manufacturing process. In another embodiment the fragrance may be added to the material using a film process. The fragrance may be a volatile substance, such as a fragrant oil, an odor neutralizer, or the like. Such advantageous embodiments eliminate the need for the use of a lavatory deodorizer or urinal cake that may be inconvenient and costly to consistently replace.

In all embodiments of the appearance changing urine splatter suppression device 1 some thermochromic material will be used, primarily on the anti-splash target 2 itself. The target 2 may be made or coated with thermochromic material. In a preferred embodiment a thermochromic pigment, ink, or dye may be added in during the manufacturing process, e.g., during the extrusion or molding phase of the manufacturing process. The thermochromic pigment, ink, or dye may be, without limitation, spirolactone, spiropyran, fluoran, leuco dyes, liquid crystal based, or fulgide, as commonly used by those of ordinary skill in the art. In other embodiments, another type of material may be used to form the thermochromic material. In other embodiments, thermochromic paints, coatings, and markings may be used to create patterns, stripes, shading, marks, letters, numbers, symbols, logos and images onto the target 2.

The thermochromic material allows the urine splatter suppression device 1 to change appearances with temperature changes, e.g., that which occurs when warm urine strikes the target 2 comprising thermochromic materials. Generally speaking, urine leaves the human body at around 98° F., while the water in a toilet is between room temperature around 72° F. and ground water temperature around 50° F. The thermochromic materials used are designed to change in the range of these temperatures. When a user approaches a toilet 4 or urinal 5 and observes the appearance changing urine splatter suppression device 1 installed as illustrated in FIGS. 18 & 1C, the target 2 will generally have one appearance, e.g., a blue color. However, once the user starts to urinate, and directs his 98° F. urine stream onto the target 2, he will notice an almost immediate appearance change start to take place, e.g., the target starts to turn yellow. Once the user had finished urinating, the target, depending on environmental conditions, will remain in its altered appearance state for a minute or two. However as is generally the case after urination is complete, the user may flush the toilet 4 or urinal 5, and cool water will come rushing down the toilet bowl 41 or urinal bowl walls 51 and wash over the appearance changing urine splatter suppression device 1. The water will cool the target 2, reverting it back to its initial appearance, e.g., a blue color. This novel and repeatable appearance changing property has several advantages. The primary advantage being that the transformation is exciting and engaging and will encourage users to aim their stream at the anti-splash target 2 further increasing the efficacy of the device's primary purpose. This primary advantage is a reason why the appearance changing urine splatter suppression device 1 can be such an effective tool to use when training young boys to begin peeing standing up. A secondary advantage is a user can see by the partial or full appearance transformation when a flush occurs, whether or not the appearance changing urine splatter suppression device 1 is in an optimal position for self-cleansing, if the appearance transformation is not complete it may mean the user should reposition the device 1 to a location where an increased supply of water will flush over the device 1.

Figure 8:
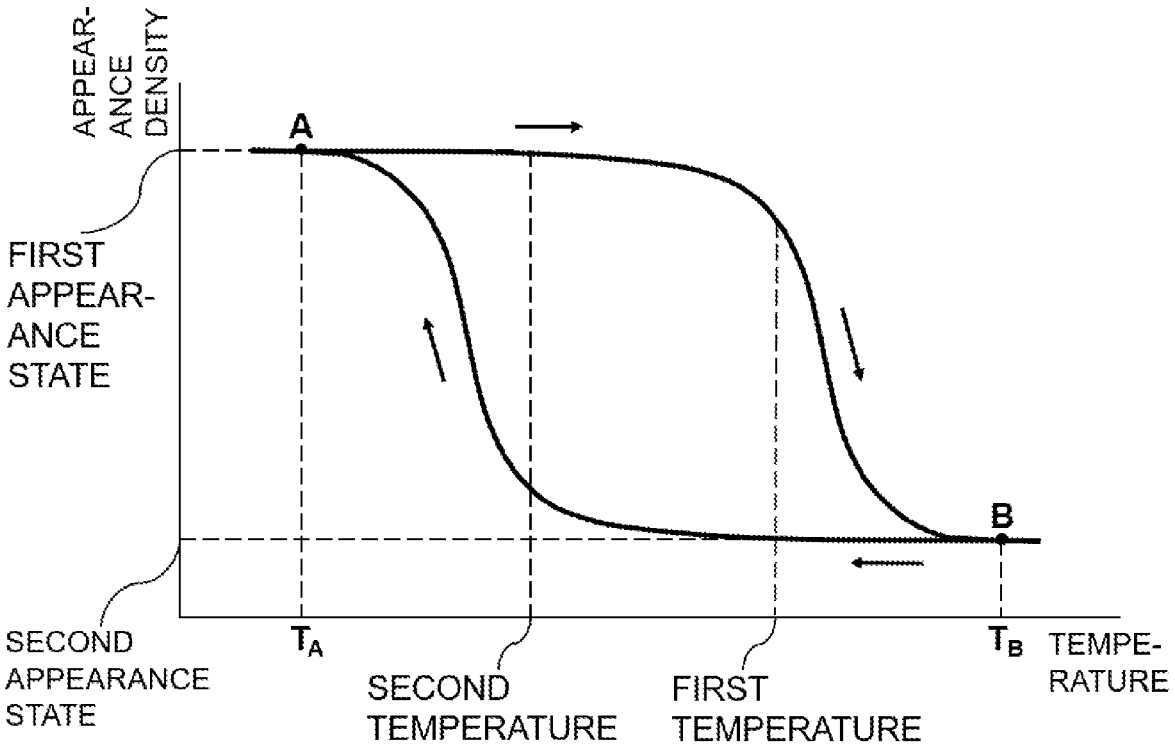
FIG. 8 is a graph illustrating the hysteresis of the reversible thermochromic appearance change which is used in the present invention.

For a more analytical understanding of the appearance change, FIG. 8 was included to show the hysteresis characteristic as follows. The shape of the curve obtained by plotting the appearance density as a function of temperature depends on whether the temperature is changing from below to above the range of appearance changing temperature or from above to below in the same range. Therefore, the curves in the foregoing two cases form a loop when they are combined. Assuming that the temperatures at the junctions between the two curves at the opposite ends of the loop at the lower and higher sides are represented by T A and T B respectively, the reversible thermochromic appearance according to the present invention is characterized in that the lower temperature T A is a temperature to be commonly experienced in a lavatory and by water that is flushed from a toilet or urinal, that is, a temperature within a range of about 50° F. to 75° F., and the higher temperature T B is a temperature obtainable from male urine which is within a range from 90° F. to 100° F. With this reversible thermochromic appearance, the range of temperature in which both the first appearance state and second appearance state can co-exist extends over the range of ordinary temperature. This range will hereinafter be referred to as the "two-appearance holding temperature range". Particularly, the reversible thermochromic appearance in which the two-appearance holding temperature range exists within the range of ordinary temperature of from about 75° F. to 90° F. is preferably selected.

Figure 6A:
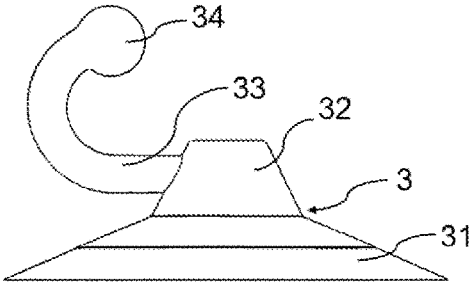
FIG. 6A is a side view of a suction cup with hook.
Figure 6B:
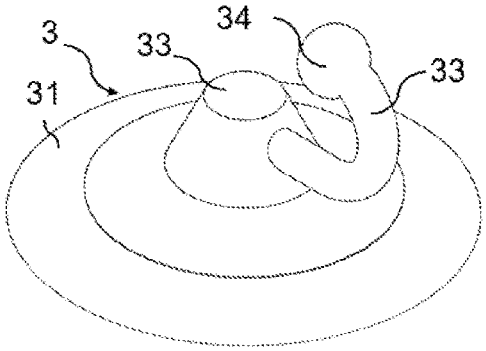
FIG. 6B is a perspective view of a suction cup with hook.

The preferred embodiment of the target 2 also comprises at least one loop 22 on its exterior surface which can be used to secure a tether 8 as shown in FIG. 2 or used as a mounting point for a hook 33 as shown in FIGS. 1A & 1D. The hook 33 is part of the suction cup base 3. The actual removable suction cup 31 can be used to affix the current embodiment of the urine splatter suppression device 1 onto the bowl of a toilet 41 or inner walls of a urinal 51. As seen in FIGS. 6A & 6B, the hook 33 can comprise an impediment 34 at the end of it to prevent the accidental removal of the target 2 should the loop 22 be jostled during every day use. To further secure the device from accidental flushing, and potential costly plumbing repairs, a back-up tether 8 can be used to secure the urine splatter suppression target 2 and the base 3 to a fixture of the toilet. FIG. 2 shows an example of a tether 8 comprising a monofilament line that is tied 81 to the target 2 and base 3 on one end, and tied 81 to the hinge of the toilet seat 42. For toilets 4, the preferred location to place the appearance changing urine splatter suppression device 1 is slightly above the toilet bowl water line at the rear center portion of the toilet bowl wall 41 as illustrated in FIG. 1B. Some users may choose to install the device now enough so the target 2 makes contact with the pool of water in a toilet 4 bowl, this can have the advantageous effect of further minimizing splash effects by breaking the surface tension of the water in the toilet bowl, however the disadvantage to such a position is the potential for the target 2 to come in contact with excrement. An added benefit of the appearance changing urine splatter suppression device 1 is that it can muffle the embarrassing noise typically heard when a urine stream makes contact with toilet 4 bowl water. Having the target lower towards the toilet bowl water can enhance the noise reduction effect.

For urinals 5, an ideal position for the device 1 is towards the horizontal middle, and lower down towards the drain from a vertical perspective. It is advantageous for users to engage a target 2 that is lower, as this promotes a urine stream that will make contact with a downward trajectory, allowing the forces of gravity to best contain any escaping splashes within the urine receptacle; for this same reason the horizontal center, being the furthest from the outer boundaries of the urine receptacle, is the ideal placement location for the appearance changing urine splatter suppression device 1. For some toilets with a side flushing function, or for some users whose urine streams do not have the requisite force to reach the rear of the toilet it may prove better to position the device 1 elsewhere along the inner wall of the toilet bowl 41. For a more secure and long-lasting mounting of the suction cup base 3 to the toilet bowl 41 or urinal bowl wall 51, a thin film of petroleum jelly or petrolatum may be spread thinly over the inner lips of the removable suction cup 31. The toilet bowl 41 or urinal wall 51 should also be cleaned at the mounting location with a mild detergent prior to mounting.

Figure 4A:
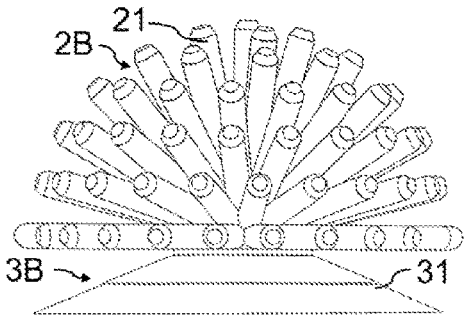
FIG. 4A is a side view of yet another embodiment according to the present invention.
Figure 4B:
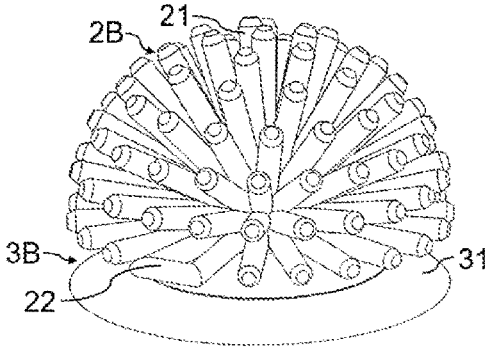
FIG. 4B is a perspective view of the appearance changing urine splatter suppression device of FIG. 4A.
Figure 5A:
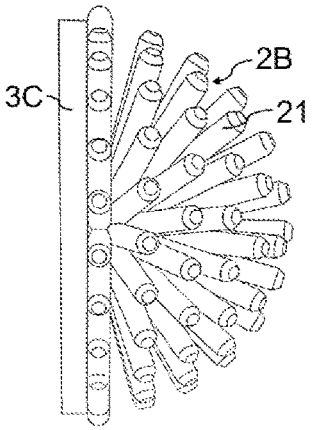
FIG. 5A is a side view of still another embodiment according to the present invention.
Figure 5B:
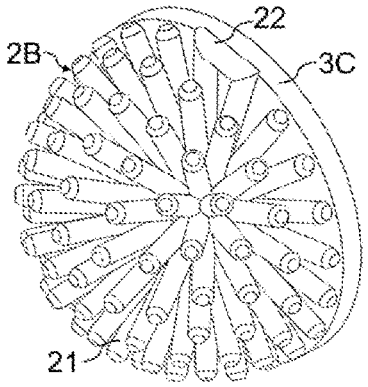
Figure 6C:
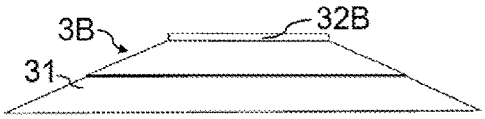
FIG. 6C is a side view of a suction cup with a flat top.
Figure 6D:
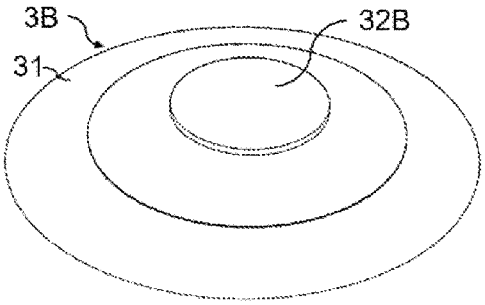
FIG. 6D is a perspective view of a suction cup with a flat top.
Figure 6E:
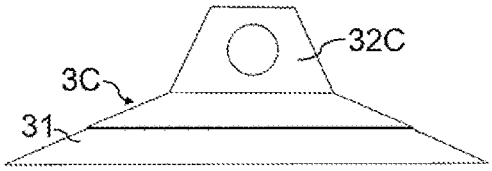
FIG. 6E is a side view of a suction cup with a hole through its base.

Hither to we have discussed the suction cup base 3 with hook to affix the target 2 onto the walls of a urinal 51 or toilet 41. There are many ways to affix a target, comprising the use or combined use of a suction cup, multiple suction cups, adhesives, cable ties, hooks, a screw, a bolt, a pin, a barb, and the like. In FIGS. 6C & 6D, an embodiment of a suction cup with a flat top surface 3B is illustrated. In FIGS. 4A & 4B an alternate embodiment of an appearance changing urine splatter suppression device is shown where a hemispheroidal anti-splash target 2B has been joined at the flat 32B of the suction cup 3B to make a simpler appearance changing urine splatter suppression device. In FIG. 6E we see yet another embodiment of a suction cup 3C this one with a hole running through its base 32C. The hole can be used for a myriad of options, including but not limited to affixing an anti-splash target to it by means of a cable tie or other flexible elongated member. In FIGS. 5A & 5B we see yet another embodiment of an appearance changing urine splatter suppression device where the hemi-spheroidal anti-splash target 2B has been joined to an adhesive 3C which can be simply affixed to the toilet bowl 41 or urinal bowl 51. The adhesive can be one of a temporary nature and removable without leaving stains or markings or a permanent adhesive. Another alternate embodiment is to simply not affix the target 2 to the walls of a toilet 41 or urinal 51, and simply tie a knot 81 around the loop 22 with a flexible elongated member and also tie it at the other end to a fixture of the toilet 4 or urinal 5, thereby simply suspending the hydrodynamically shaped target within the confines of the toilet 4 bowl or urinal 5.

Figure 3:
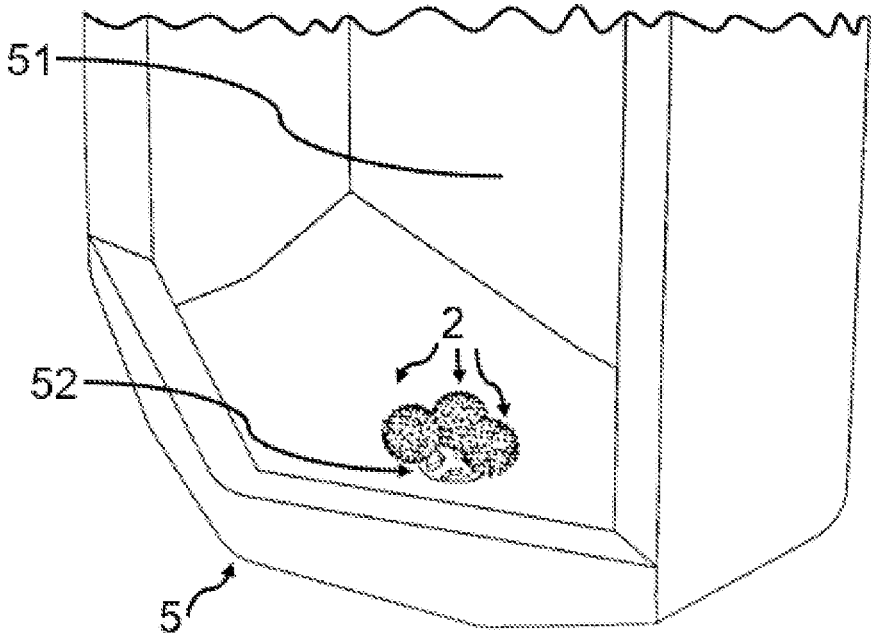
FIG. 3 illustrates another embodiment of the device of the invention showing multiple appearance changing anti splash targets detached in the bowl of a urinal.

There is one final embodiment of the appearance changing urine splatter suppression device 1, which is distilled down to just the appearance changing anti-splash target 2. As illustrated in FIG. 3, the target 2, or multiple targets 2 can be placed loosely at the base of a urinal towards the drain 52 or on top of a urinal screen and allowed to perform its function as an appearance changing anti-splash target.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

The invention claimed is:

1. A urine splatter suppression device that is removable and designed for use, without modification, in the bowl of a urinal and feces-receiving toilet comprising:

a anti-splash target with a diametric size between 15 mm and 50 mm comprising at least one hydrodynamic shape selected from a group consisting of spheroids, spheres, ellipsoids, frustocones, cones, hemi-spheroids, domes, cupolas, geodesics, polyhedrons and hemi-polyhedrons; and the anti-splash target having thermochromic reversible appearance changing properties and having a temperature hysteresis characteristic for changing between a first and second appearance state, wherein said target changes from said first appearance state to said second appearance state at the locations where it comes in contact with warm urine and the target is heated at a upper temperature above a first temperature;

the target maintains a present one of said first and second appearance states within a two-appearance holding temperature range between said first temperature and second temperature, and changes from said second appearance state to said first appearance state when cool flushing water at a lower temperature below said second temperature cools the target, wherein said two-appearance holding temperature range is within a range of ordinary temperature.

2. The urine splatter suppression device of claim 1, wherein the hydrodynamic shape has a drag coefficient of less than 0.75.

3. The urine splatter suppression device of claim 2, wherein the shape comprises at least one anti-splash feature selected from a group consisting of a plurality of protrusions, a plurality of apertures, and a mesh of densely packed filaments.

4. The urine splatter suppression device of claim 3, wherein one or more of the anti-splash protrusions is shaped as a loop whereby it acts as a connection point for a tether or coupling member.

5. The urine splatter suppression device of claim 1, wherein the thermally-actuated appearance changing properties are reversible for the entire target or parts of the target.

6. The urine splatter suppression device of claim 5, wherein the reversible thermally-actuated appearance change comprises at least one change selected from a group consisting of color, opacity, shading, patterns, marks, letters, symbols, logos, and images.

7. The urine splatter suppression device of claim 1, wherein a coupling member attaches the target to the bowl of a urinal or toilet;

the coupling member comprises at least one item selected from a group consisting a suction cup, a plurality of suction cups, a hook, an adhesive, a suction cup with an integrated hook, a suction cup with a hole, a cable tie, a screw, a bolt, a pin, and a barb.

8. The urine splatter suppression device of claim 4, wherein a flexible elongated member secured on one end to a fixture of the toilet or urinal suspends the hydrodynamically shaped target within the confines of the bowl of the toilet or urinal.

9. The urine splatter suppression device of claim 1 wherein the device is able to fit in a toilet without modification and is sized and placed as to not come into contact with falling or flushing excrement.

10. A urine splatter suppression device comprising an anti-splash target with thermally actuated reversible appearance changing properties that is removable and for use, without modification, in the bowl of a urinal and toilet wherein the target is spheroidal with a diametric size between 15 mm and 50 mm and comprising at least one anti-splash feature selected from a group consisting of a plurality of protrusions, a plurality of apertures, and a mesh of densely packed filaments.

11. The urine splatter suppression device of claim 10 wherein the target affixes itself to the inner walls of a toilet bowl or urinal by means of a suction cup.

12. The urine splatter suppression device of claim 4 wherein the target has a back-up tether that prevents accidental flushing of the urine splatter suppression device comprising a securing tether tied to the urine splatter suppression target, and securing the other end of the tether to a permanent fixture of the urine receptacle.

13. The urine splatter suppression device of claim 12 wherein the tether also secures the base of the urine splatter suppression device from accidental flushing.

14. A urine splatter suppression device comprising at least one hydrodynamically shaped target with a diametric size between 15 mm and 50 mm, and thermally actuated appearance changing properties that is left unsecured and untethered at the base of the bowl of a urinal.

15. The urine splatter suppression device of claim 1 wherein the target comprises at least one of odor combating chemistry and scents.

16. The urine splatter suppression device of claim 1 wherein the device is also used to reduce noise.

17. The urine splatter suppression device of claim 1 wherein the material composition of the target comprises thermochromic pigment, ink, or dye.

18. The urine splatter suppression device of claim 1 wherein the device is used as a toilet training device for young boys learning to urinate in a standing orientation.

19. The urine splatter suppression device of claim 5, wherein the reversible thermally-actuated appearance change comprises at least one change selected from a group consisting of opacity, shading, and patterns.

20. The urine splatter suppression device of claim 1, wherein the device consists of:

a spherical anti-splash target with a diametric size between 15 mm and 50 mm;

the anti-splash target's spherical surface is covered in a plurality of protrusions;

the target is made entirely of a homogeneous plastic; and at least one of the anti-splash protrusions is shaped as a loop whereby it acts as a connection point for a tether or coupling member.

* * * * *